US005787592A

United States Patent [19]

Lai

[11] Patent Number: 5,787,592

[45] Date of Patent: Aug. 4, 1998

[54] CAN OPENER

[76] Inventor: Jung-Tsung Lai, P.O. Box 24-108, Taipei, Taiwan

[21] Appl. No.: 908,159

[22] Filed: Aug. 7, 1997

Related U.S. Application Data

[63] Continuation of Ser. No. 661,472, Jun. 11, 1996, abandoned.

[51] Int. Cl.[6] ..... B67B 7/46

[52] U.S. Cl. ..... 30/418; 30/426

[58] Field of Search ..... 30/410, 416–418, 30/422, 424–427, 430, 440–441

[56] References Cited

U.S. PATENT DOCUMENTS

| | | | |
|---|---|---|---|
| 1,360,256 | 11/1920 | Anderson | 30/15.5 |
| 1,825,216 | 9/1931 | Thybony et al. | 30/417 |
| 2,541,916 | 2/1951 | Dakome | 30/431 |
| 5,121,546 | 6/1992 | Chong | 30/418 |
| 5,347,720 | 9/1994 | Pereira | 30/422 |

*Primary Examiner*—Douglas D. Watts
*Attorney, Agent, or Firm*—Bacon & Thomas

[57] ABSTRACT

An improved can opener includes a disk-like cutter having an inwardly furled rim at a lower edge thereof and pivotally connected to a press lever at a slightly slanting angle, the press lever being pivotally connected via a pivot pin to a handle having a serrated disk rotatable by a rotary knob. When the press lever and the handle are pulled away from each other about the pivot pin, the distance between the serrated disk and the cutter is increased so that a top side of the can can be placed therebetween. By pressing the press lever, the cutter will displace towards the serrated disk, with a part of its cutting blade piercing into an outer peripheral portion of the top side of the can. When the rotary knob is turned, the serrated disk is caused to displace along an inner peripheral portion of the can and the cutter is caused to rotatably cut along the outer peripheral portion of the top side of the can. As the cutter is disposed at a slightly slanting angle, the cutting blade may press against the freshly cut edge of the top side of the can and cause it to curl inwardly, thus preventing the cut edge from hurting people.

2 Claims, 3 Drawing Sheets

CAN OPENER

This application is a continuation of application Ser. No. 08/661,472, filed Jun. 11, 1996, now abandoned.

BACKGROUND OF THE INVENTION (a) Field of the Invention

The present invention relates generally to a can opener, and more particularly to an improved can opener which can turn the sharp edge of the lifted lid of the can downwardly to avoid hurting people.

(b) Description of the Prior Art

Cans are commonly used to preserve food. One major disadvantage with canned products, especially cans made of iron, is that after the can is opened with a can opener, the lifted lid will have a sharp and serrated edge, which may hurt people. An improvement of prior can openers is therefore necessary.

SUMMARY OF THE INVENTION

According, a primary object is to provide an improved can opener which can turn the sharp edge of the lifted lid of the can downwardly to prevent the sharp edge from hurting people.

In order to achieve the afore-mentioned object, the improved can opener of the present invention essentially comprises a disk-like cutter having an inwardly furled rim at a lower edge thereof pivotally connected to a front end of a press lever at a slightly slanting angle, the press lever being pivotally connected via a pivot pin to a handle having a serrated disk rotatable by a rotary knob. When the press lever is pulled away from the handle about the pivot pin, the distance between the cutter and the serrated disk is increased so that a top side of the can may be arranged therebetween. When the press lever is pressed towards the handle, the cutter will displace near to the serrated disk with a part of its cutting blade piercing into an outer peripheral portion of the top side of the can. By turning the rotary knob, the serrated disk is caused to turn along an outer peripheral portion of the top side of the can while the cutter cuts along the outer peripheral portion of the top side of the can. Due to the slightly slanting angle of the cutter, the downwardly moving cutting blade may press against the freshly cut edge of the can to cause it to furl inwardly, thus preventing it from hurting people.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
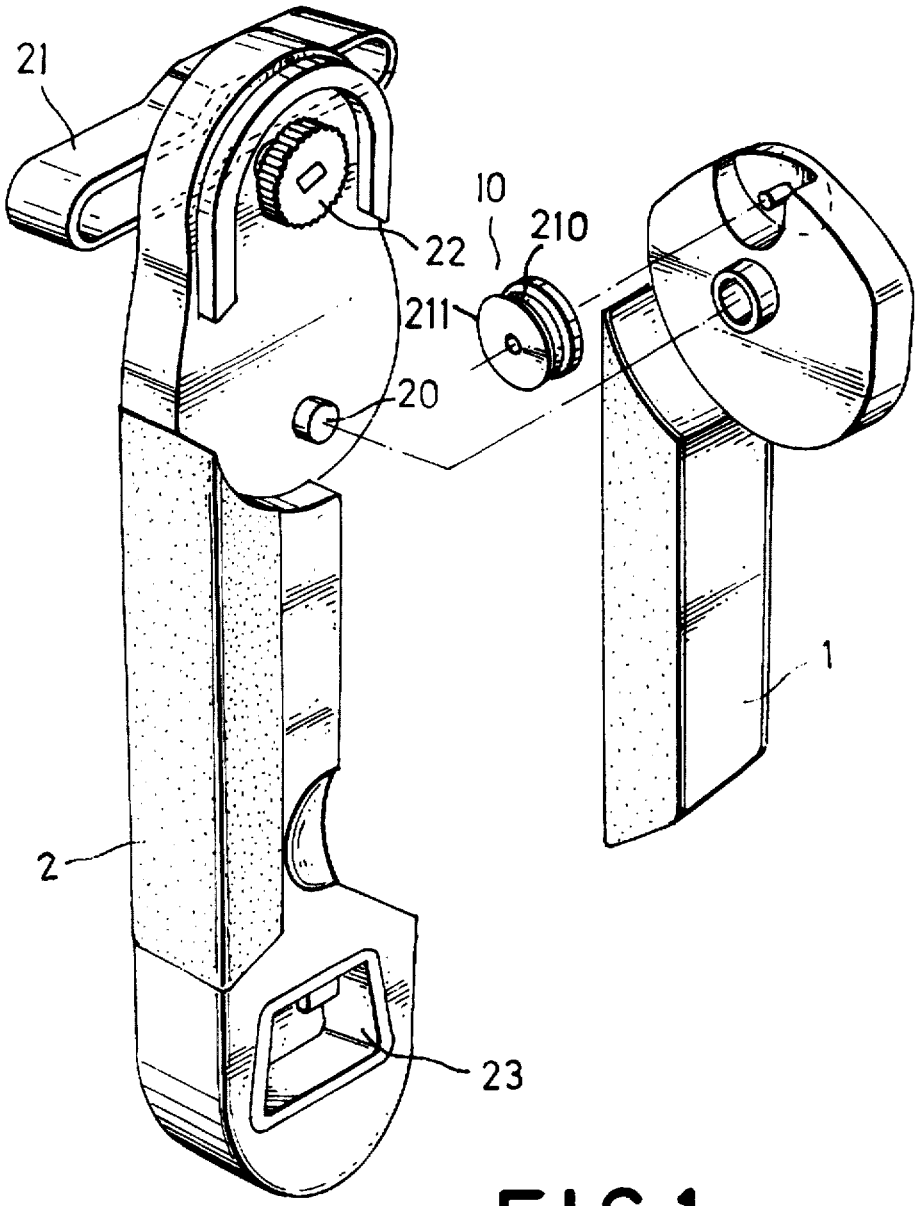
FIG. 1 is an elevational exploded view of the improved can opener of the invention.
Figure 2:
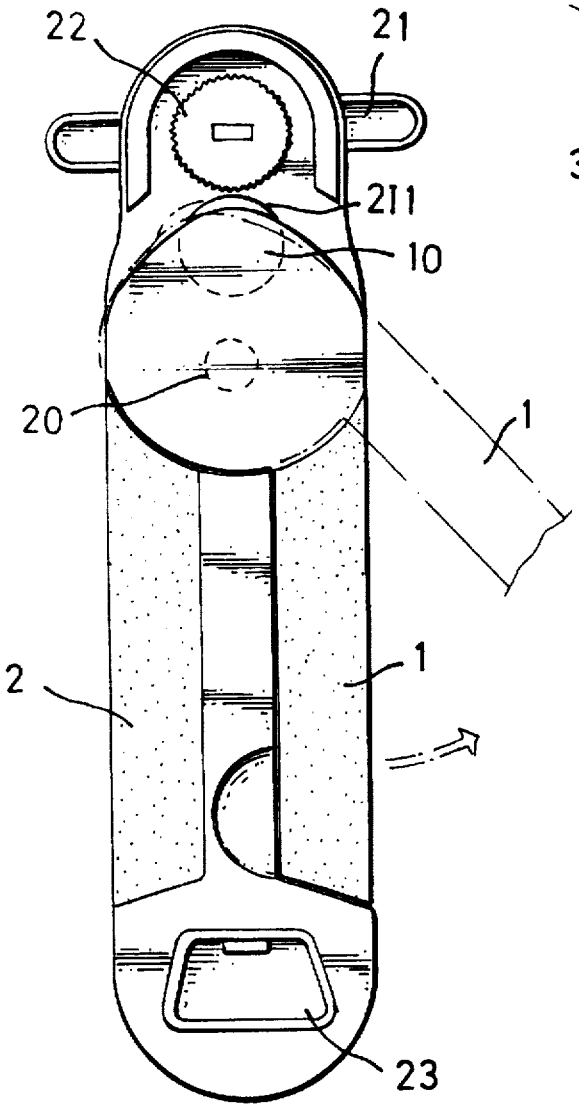
FIG. 2 is a side view of the improved can opener of the invention.
Figure 3:
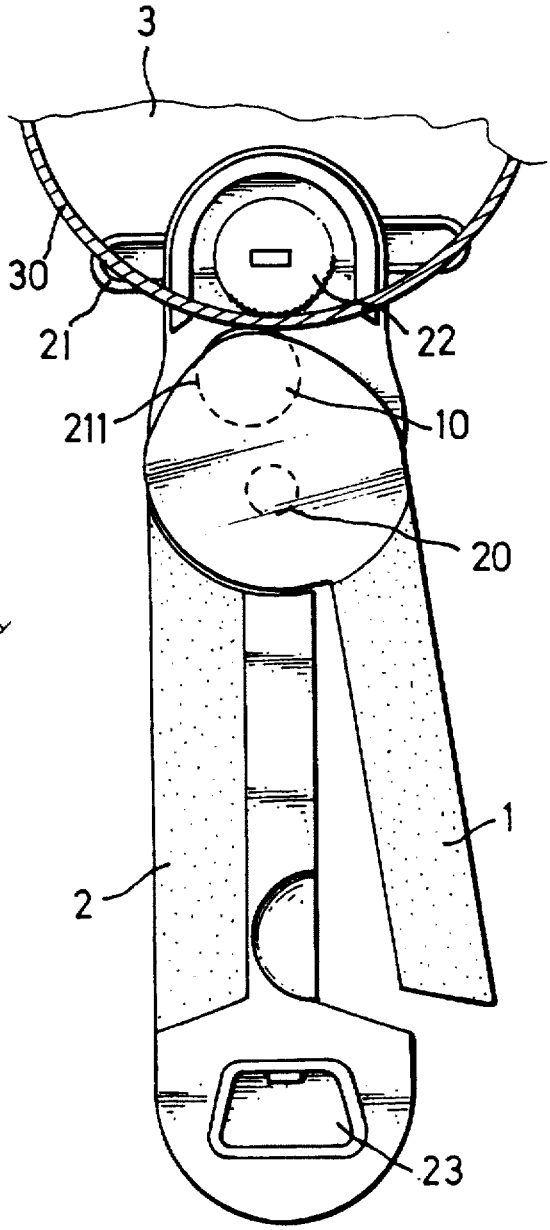
FIG. 3 is a side view of the improved can opener of the invention in use.
Figure 4:
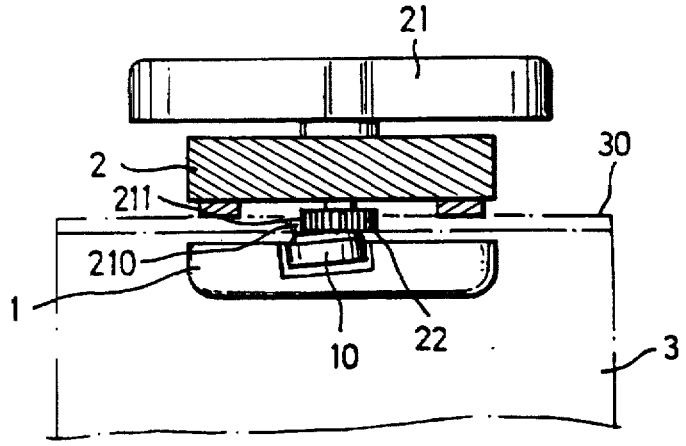
FIG. 4 is a front view of the improved can opener of the invention.
Figure 5:
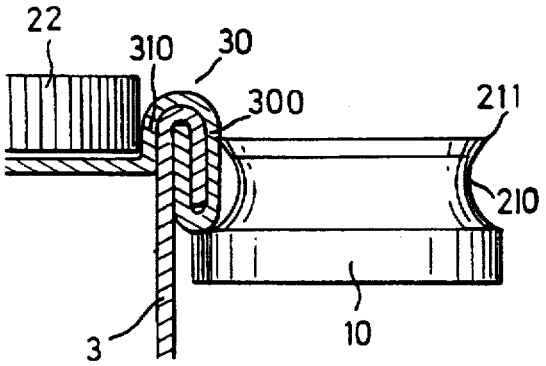
FIG. 5 is a sectional view of the improved can opener of the invention before use.
Figure 6:
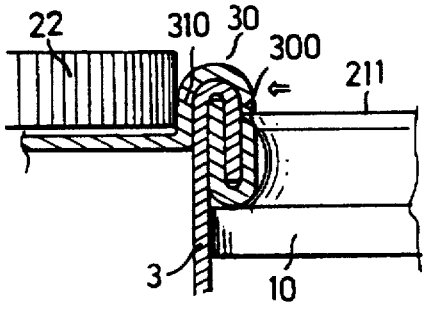
FIG. 6 is a sectional view of the improved can opener of the invention during an opening operation.
Figure 7:
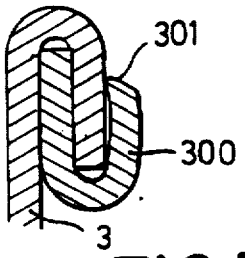
FIG. 7 is a sectional view of the cut edge of the can after the opening operation.

With reference to the drawings, the improved can opener according to the present invention essentially comprises a press lever 1 and a handle 2 pivotally joined together. The press lever 1 may turn with a pivot pin 20 and its front end is pivotally connected, at a slightly slanting angle, to a disk-like cutter 10 having a lower edge curling inwardly to form a furled rim 210. A front end of the handle 2 has a serrated disk 22 rotatable by a rotary knob 21. The serrated disk 22 and the cutter 10 are arranged at opposite positions. When the press lever 1 and the handle 2 are pulled apart from each other about the pivot pin 20, the cutter 10 may be brought to move farther away from the serrated disk 22, forming a greater gap therebetween. On the contrary, if the press lever 1 is pressed, the cutter 10 will displaced near to the serrated disk 22 with a part of its cutting blade 211 piercing into an outer peripheral portion 300 of a top side of a can 3. If desired, a lid lifter 23 may be arranged at a bottom end of the handle 2 to provide another function for the improved can opener of the invention.

In actual use, the press lever 1 and the handle 2 are pulled apart first, bringing the cutter 10 to displaced away from the serrated disk 22 to form a greater gap therebetween, so that a top edge 30 of the can 3 is located therebetween. By closing the press lever 1 onto the handle 2, the cutter 10 is brought near to the serrated disk 22 so that the cutting blade 211 pierces into the outer peripheral portion 300 of the can 3. At this point, by turning the rotary knob 21, due to the action of the serrated edge of the serrated disk 22, the latter is caused to turn along an inner peripheral portion 310 of the can 3, bringing the cutter to cut along the outer peripheral portion 300 of the can 3 as well. Since the cutter 10 is arranged to have a slightly slanting angle, the gradually and downwardly moving cutting blade 211 may press against the freshly cut edge 301 to cause it to furl inwardly, eliminating the drawback with prior can openers.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved can opener for opening a can having a top edge with an outer peripheral portion and an inner peripheral portion, the can opener comprising:

(a) a press lever having a front end, (b) a disk-like cutter rotatably connected to said front end of said press lever, the cutter having a cutting blade, a lower rim spaced from the cutting blade and extending radially outwardly beyond a periphery of the cutting blade, and a concavely curved portion connecting the cutting blade and rim, the disk-like cutter located such that the cutting blade contacts the outer peripheral portion of the top edge of the can;

(c) a handle pivotally connected to said press lever, whereby the press lever is movable toward and away from the handle, said handle having a front end;

(d) a disk having a serrated edge rotatably connected to the front end of the handle such that the serrated edge is adjacent to the cutting blade, the disk having a substantially cylindrical configuration and located such that the serrated edge engages the inner peripheral portion of the top edge of the can; and (e) a rotary knob connected to the disk such that rotation of the rotatable knob causes rotation of the serrated disk.

2. The improved can opener as claimed in claim 1, wherein said handle further comprises a lid lifter disposed at a bottom end thereof.

* * * * *